US006545397B2

(12) United States Patent
Ohira et al.

(10) Patent No.: US 6,545,397 B2
(45) Date of Patent: Apr. 8, 2003

(54) CATHODE FOR ELECTRON TUBE

(75) Inventors: Takuya Ohira, Tokyo (JP); Hiroyuki Teramoto, Tokyo (JP); Keiji Fukuyama, Tokyo (JP); Kiyoshi Saitou, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 39 days.

(21) Appl. No.: 09/755,121

(22) Filed: Jan. 8, 2001

(65) Prior Publication Data

US 2002/0008453 A1 Jan. 24, 2002

(30) Foreign Application Priority Data

Jun. 1, 2000 (JP) ..... 2000-164581

(51) Int. Cl.[7] ..... H01J 1/14; H01J 19/06; H01K 1/04

(52) U.S. Cl. ..... 313/346 R; 313/310; 313/311

(58) Field of Search ..... 313/310, 311, 313/337, 346 R, 346 DC

(56) References Cited

U.S. PATENT DOCUMENTS 4,797,593 A * 1/1989 Saito et al. ..... 313/346 R
4,924,137 A * 5/1990 Watanabe et al. ..... 313/337
5,118,984 A 6/1992 Saito et al.
5,122,707 A * 6/1992 Nakanishi et al. ..... 313/346 R
5,216,320 A * 6/1993 Koizumi ..... 313/346 R
5,504,385 A * 4/1996 Jin et al. ..... 313/310
6,034,469 A * 3/2000 Uda et al. ..... 313/346 R
6,362,563 B1 * 3/2002 Chou et al. ..... 313/346 R

FOREIGN PATENT DOCUMENTS

| | | |
|---|---|---|
| JP | 3-257735 | 11/1991 |
| JP | 10-144202 | 5/1998 |
| JP | 10-162719 | 6/1998 |
| KR | 2000-0009399 | 2/2000 |

OTHER PUBLICATIONS

U.S. patent application Ser. No. 08/979,566, filed Nov. 26, 1997.
U.S. patent application Ser. No. 09/462,071, filed Jan. 5, 2000, pending.

* cited by examiner

*Primary Examiner*—Sandra Brase
(74) *Attorney, Agent, or Firm*—Oblon, Spivak, McClelland, Maier & Neustadt, P.C.

(57) ABSTRACT

A cathode for an electron tube provided with a base containing at least one kind of reducing agent, a metal layer whose main component is tungsten formed on the base, and an electron emission material layer whose main component is an alkaline-earth metal oxide including barium formed thereon, deformation of the base in operation is controlled by composing the metal layer with a porous metal layer and limiting the thickness and the porosity of the metal layer. As a result, it is possible to achieve a cathode for an electron tube applicable to a cathode-ray tube for a display in which the cutoff voltage is liable to change.

8 Claims, 2 Drawing Sheets

CATHODE FOR ELECTRON TUBE

BACKGROUND OF THE INVENTION

1. Field of the Invention

The present invention relates to a cathode for an electron tube used in a cathode-ray tube or the like.

2. Description of the Related Art

FIG. 3 shows a conventional cathode for an electron tube disclosed in the Japanese Laid-Open Patent Publication 257735/1991. In the drawing, reference numeral 1 is a base (substrate) composed of a material, in which main component is nickel and a very small amount of reducing elements such as silicon (Si) and magnesium (Mg) is contained. Numeral 5 is an electron emission material layer, in which main component is an alkaline-earth metal oxide 11 containing barium and strontium or/and calcium, and a rare-earth metal oxide 12 such as scandium oxide of 0.1 to 20 weight % is contained. Numeral 2 is a cathode sleeve composed of nichrome and so on. Numeral 3 is a heater placed in the base 1 and emits thermions from the electron emission material layer 5.

Described below is a method for manufacturing the cathode for electron tube composed as described above as well as properties thereof. First, a reducing metal such as tungsten is formed on the upper face of the base so that thickness may be approximately 1 $\mu$m through vacuum deposition or the like. Next, ternary carbonate of barium, strontium, and calcium and a predetermined amount of scandium oxide are mixed with a binder and a solvent in order to prepare a suspension. This suspension is applied on the base 1 to be approximately 80 $\mu$m in thickness through spraying. After that, they are heated by the heater 3 in a vacuum evacuation process of a cathode-ray tube, and the carbonate is turned into oxide. After that, in a process called an activation process, a part of the alkaline-earth metal oxide is reduced and a free barium to be an electron emission source is formed due to reduction effect of said metal layer and a very small amount of reducing agent in the gas.

In this process, a part of the alkaline-earth metal oxide reacts as described below, and the free barium is generated. The reducing agent such as silicon and magnesium contained in the base 1 moves to the interface between the electron radiation material layer 5 and the base 1 due to diffusion, and reacts with the alkaline-earth metal oxide. For example, in the case where the alkaline-earth metal oxide is a barium oxide (BaO), a free barium generation reaction shown by the following expressions 1, 2 takes place:

$$2BaO+\tfrac{1}{2}Si=Ba+\tfrac{1}{2}Ba_2SiO_4 \quad (1)$$

$$BaO+Mg=Ba+MgO \quad (2)$$

The barium oxide is reduced at the interface between the metal layer 4 and the electron radiation material layer 5 due to the reduction effect of tungsten, and the free barium is generated in the same manner.

$$2BaO+\tfrac{1}{3}W=Ba+\tfrac{1}{3}Ba_3WO_6 \quad (3)$$

A scandium oxide 12 is added into the electron emission material layer 5 in order to prevent formation of an intermediate layer caused by barium silicate ($2Ba_2SiO_4$), magnesium oxide (MgO), barium tungstate ($Ba_3WO_6$), and so on generated in the foregoing expressions (1) to (3). This intermediate layer is formed at the interface between the electron emission material layer and the base and obstructs diffusion of the reducing agent.

Moreover, in the conventional cathode for electron tube, the metal layer composed of tungsten is formed on the base in order to generate the free barium as shown in the foregoing expression (3). The metal layer is formed at most 2 $\mu$m in thickness because the metal layer of at most 2 $\mu$m in thickness does not prevent reducing elements in the gas from diffusing into the electron emission material.

FIG. 4 shows an example of an electron gun for a cathode-ray tube in which the cathode for electron tube obtained as described above is used. In the drawing, numeral 6 is a control electrode, numeral 7 is an accelerating electrode, numeral 8 is a focusing electrode, numeral 9 is a high-voltage electrode, and numeral 20 is a cathode for an electron tube. In an ordinary television set or a display set, a voltage applied to the control electrode 6, accelerating electrode 7, focusing electrode 8, and high-voltage electrode 9 is fixed. Amount of electrons emitted from the electron tube cathode 20, i.e., cathode current, are controlled by modulating the voltage applied to the electron tube cathode 20 itself. For example, establishing the voltage of the control electrode 6 as standard, a voltage from 0 V to cutoff voltage is applied to the electron tube cathode 20. A voltage of plus some hundreds-volt is applied to the accelerating electrode 7. The voltage of the electron tube cathode 20 is adjusted to be near the voltage of the control electrode 6, whereby an electric field from the accelerating electrode 7 consequently permeates through an electron passage hole of the control electrode 6, and electrons are emitted toward a panel for display. The focusing electrode 8 and the high-voltage electrode 9 are arranged to focus and accelerate the electrons emitted from the electron tube cathode 20.

The mentioned cutoff voltage is one of the characteristics of a cathode-ray tube. The cutoff voltage is defined herein as "a cathode voltage at the boundary of the beginning of electron emission from the cathode under the condition of fixing the voltage excluding the voltage of the cathode". This cutoff voltage is generally determined due to the three elements of cathode, control electrode, and accelerating electrode, and depends on the space between each of the electrodes, electrode thickness, and configuration of the electron passage hole. The cutoff voltage is set to be within a predetermined voltage range corresponding to the type of electron gun. However, in the electron tube cathode having tungsten metal as described above, tungsten and nickel which is the main component of the base diffuse mutually during operation. Plastic deformation due to cubical expansion in alloy formation and plastic deformation due to yield of the base metal caused by repeatedly heating and cooling the cathode take place. It is acknowledged that the deformation is increased especially when the metal layer is formed on the whole base. It is known that the electron radiation material layer itself shrinks due to evaporation, sintering, and so on during a long-term operation. Both of the mentioned deformation and shrinkage cause a change in the space with the passage of time between the cathode and the control electrode, i.e., a change in the cutoff voltage with the passage of time.

Described below is influence in the case where the cutoff voltage changes. Change in brightness, i.e., luminance of a cathode-ray tube is mainly caused by decrease in transmission of visible radiation of the panel glass, decrease in luminous efficiency of the fluorescent substance, and decrease in current from the cathode. In particular, considering the decrease in current from the cathode, following two factors are raised. The first factor is that the current value decreases due to deterioration in the ability itself of emitting electrons from the cathode. The second factor is a change in the electric field on the surface of the cathode due to variation in the cutoff voltage. Both of the two factors result in brightness changes.

The present invention was made to resolve the above-discussed problems and has an object of providing a cathode for electron tube capable of achieving a cathode-ray tube for a display in which brightness change is small even when cutoff voltage of the electron tube cathode varies during a long-term operation.

SUMMARY OF THE INVENTION

A cathode for an electron tube according to the invention, which decreases change in cutoff voltage during a long-term operation by limiting thickness and void ratio of a metal layer formed on a base and decreasing deformation of a metal of the base, the cathode comprising, the base of which main component is nickel and which contains at least one kind of reducing agent, the metal layer formed on said base, and an electron emission material layer which is formed on said metal layer and of which main component is an alkaline-earth metal oxide containing barium, wherein a porous metal layer is used as said metal layer.

It may be preferable that, in the cathode for electron tube according to the invention, the porous metal layer is not more than 80 $\mu$m in thickness and 20 to 70% in void ratio.

It may also be preferable that, in the cathode for electron tube according to the invention, the porous metal layer is formed by the steps of forming a mixture of metal with a vacancy agent on the base, heating the mixture in vacuum or in a reducing atmosphere, to remove the vacancy agent.

It may also be preferable that, in the cathode for electron tube according to the invention, a temperature of 800 to 1100° C. is applied to the mixture at said heating step.

It may also be preferable that, in the cathode for electron tube according to the invention, the vacancy agent is composed of thermoplastic resin.

It may also be preferable that, in the cathode for electron tube according to the invention, the thermoplastic resin is methacrylate compound.

It may also be preferable that, in the cathode for electron tube according to the invention, the methacrylate compound is polymethyl methacrylate (PMMA).

It may also be preferable that, in the cathode for electron tube according to the invention, the porous metal layer is 5 to 50 $\mu$m in thickness.

It may also be preferable that, in the cathode for electron tube according to the invention, main component of the porous metal layer is a metal selected from the group consisting of tungsten, nickel, silicon, magnesium, zirconium, and aluminum.

DETAILED DESCRIPTION OF THE PREFERRED EMBODIMENT

EXAMPLE 1

Figure 1:
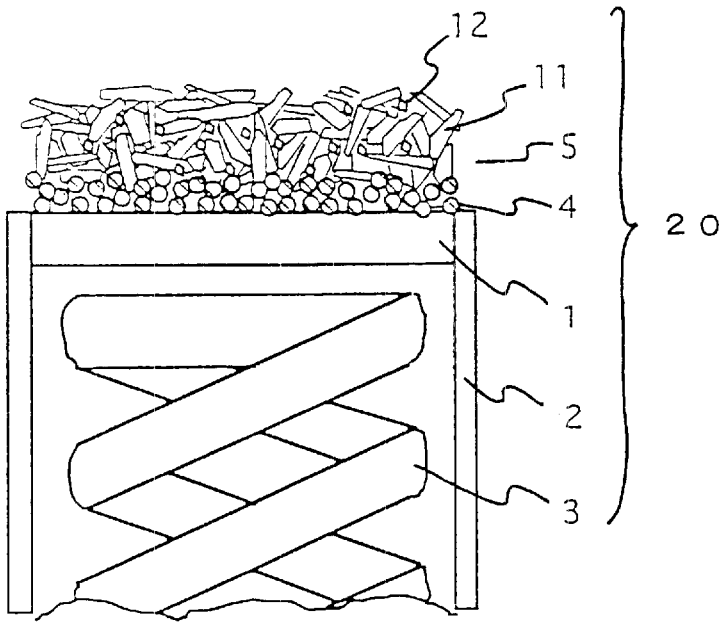
FIG. 1 is a schematic view of a cathode for electron tube according to the present invention.

An example of the preferred embodiments according to the present invention is hereinafter described with reference to the accompanying drawings. In FIG. 1, numeral 4 is a metal layer composed of tungsten and formed on an upper face of a base 1. This metal layer is formed through screen printing so that thickness thereof may be 30 $\mu$m and void ratio may be 50%. Numeral 5 is an electron radiation material layer which is formed on the metal layer 4 and is made of an alkaline-earth metal oxide containing barium and strontium or/and calcium.

Described below is a method for manufacturing this electron tube cathode 20. First, a nickel base 1 containing a small amount of silicon and magnesium is welded and fixed on a cathode sleeve 2, and a paste composed by mixing tungsten, nickel, and polymethyl methacrylate (hereinafter referred to as PMMA) is printed on the base. After that, this electron tube cathode 20 is heated, for example, at 800 to 1100° C. in a hydrogen atmosphere. The PMMA is evaporated through this heat treatment, and vacancies (holes) are left where the PMMA has been evaporated. Next, a suspension composed by mixing ternary carbonate of barium, strontium, and calcium, a binder, and a solvent is applied onto this cathode base through spraying, whereby an electron radiation material layer of approximately 100 $\mu$m in thickness is formed.

Figure 4:
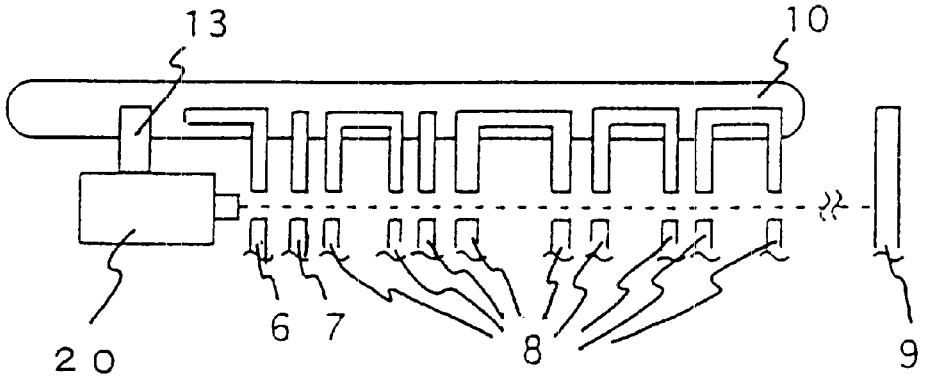
FIG. 4 is a schematic view of an electron gun in which the cathode for an electron tube according to the invention is built.

Next, this electron tube cathode 20 is built in an electron gun for display as shown in FIG. 4, in which the electron tube cathode 20 is fixed solidly to a cathode supporting structure 13 so that surface of the electron tube cathode 20 and a control electrode 6 are spaced from each other at a predetermined value. In FIG. 4, numeral 7 is an accelerating electrode, numeral 8 is a focusing electrode, and numeral 9 is a high-voltage electrode. A supporting member 10 is electrically insulating, and is aimed to keep the electrodes at a predetermined distance between one and another. A cathode-ray tube is manufactured through a conventional method for manufacturing a cathode-ray tube.

Figure 2:
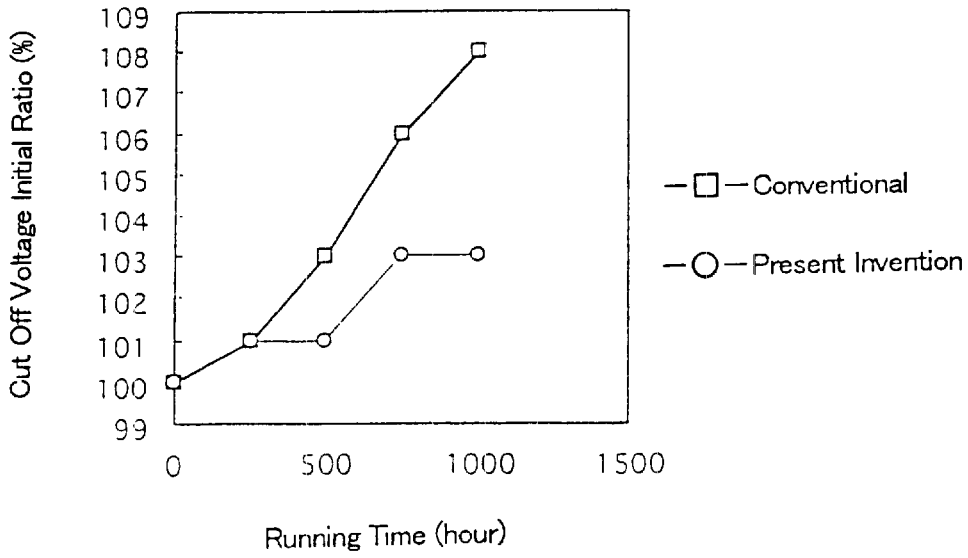
FIG. 2 is a diagram for showing a change in cutoff voltage of the cathode for electron tube according to the invention with the passage of time.
Figure 3:
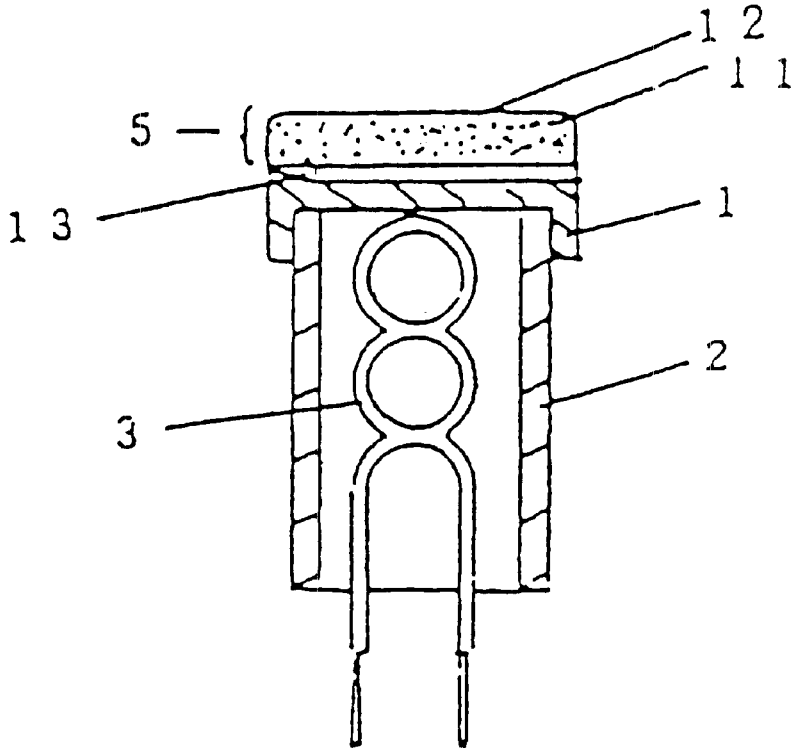
Fig. 3 PRIOR ART
FIG. 3 is a sectional view showing a conventional cathode for an electron tube.

Described below is a change in cutoff voltage during a long-term operation of the electron tube cathode according to the invention. FIG. 2 shows a change in cutoff voltage of the cathode according to the invention with the passage of time and that of the conventional cathode in which a metal layer is formed on the whole upper face of the base. In the drawing, the longitudinal axis shows the operating time and the transverse axis shows the initial ratio of the cutoff voltage. This drawing clearly shows that the cutoff voltage of the cathode of the invention changes less as compared with that of the conventional electron tube cathode.

In the case where the void ratio of the metal layer is small, tungsten in the metal layer and nickel which is the main component of the base metal mutually diffuse more during operation, and cubical expansion in the vicinity of the surface of the base on the side where the metal layer is formed increases due to increase in amount of formation of a tungsten-nickel alloy. There is a large difference between the rate of expansion of nickel being the main component of the base and the thermal expansion of the tungsten-nickel alloy formed near the surface of the base, and therefore a yield phenomenon takes place in the base when the electron tube cathode is repeatedly heated and cooled, and the whole base is deformed. Amount of such deformation increases as the void ratio is smaller. In the case of using a mixture of tungsten and nickel as the metal composing the metal layer, thermal expansion difference from the base is decreased, and deformation amount is also decreased.

On the other hand, in the case where the void ratio is large, the deformation amount of the base is small, but the region where a tungsten-nickel alloy, which is formed during operation, is not formed increases. An intermediate layer such as $Ba_2SiO_4$ being an insulating material is formed in the region, and this prevents diffusion of the reducing agent. As a result, a negative influence is exerted on a life characteristic.

Concerning the thickness of the metal layer, when the metal layer is excessively thin, for example, reducing effect of tungsten is decreased and a negative influence is exerted on a life characteristic. On the other hand, when the metal layer is excessively thick, less Si and Mg, which are the reducing agent in the base, are diffused up to the surface of the base and a negative influence is exerted on a life characteristic in the same manner.

The cathode for an electron tube according to the invention is applicable not only to a cathode-ray tube for a television but also to a cathode-ray tube for display in which the cutoff voltage is liable to change. Thus, it is possible to increase brightness due to operation in high current density and, at the same time, decrease change in brightness by decreasing cutoff change.

As described above, according to the invention, in a cathode for an electron tube provided with a base containing at least one kind of reducing agent, a metal layer whose main component is tungsten formed on the base, and an electron emission material layer whose main component is an alkaline-earth metal oxide including barium formed thereon, deformation of the base in operation is controlled by composing the metal layer with a porous metal layer and limiting the thickness and the void ratio of the metal layer. As a result, it is possible to achieve a cathode for an electron tube applicable to a cathode-ray tube for a display in which the cutoff voltage is liable to change.

What is claimed is:

1. A cathode for an electron tube comprising:

a base of which a main component is nickel and which contains at least one kind of reducing agent;

a metal layer formed on said base; and an electron emission material layer which is formed on said metal layer and of which a main component is an alkaline-earth metal oxide containing barium, wherein a single porous metal layer is used as said metal layer, and wherein said porous metal layer has a thickness of not more than 80 $\mu$m and a porosity of 20 to 70%.

2. A cathode for an electron tube according to claim 1, wherein said porous metal layer is that formed by the steps of applying a mixture of metal with a vacancy agent on the base, heating the mixture in vacuum or in a reducing atmosphere, to remove the vacancy agent.

3. A cathode for an electron tube according to claim 2, wherein a temperature of max. 800 to 1100° C. is applied to the mixture of the metal with the vacancy agent at said heating step.

4. A cathode for an electron tube according to claim 2, wherein said vacancy agent is composed of a thermoplastic resin.

5. A cathode for an electron tube according to claim 4, wherein said thermoplastic resin is an acrylate resin.

6. A cathode for an electron tube according to claim 5, wherein said thermoplastic resin is polymethyl methacrylate (PMMA).

7. A cathode for an electron tube according to claim 1, wherein said porous metal layer is 5 to 50 $\mu$m in thickness.

8. A cathode for an electron tube according to claim 1, wherein main component of said porous metal layer is a metal selected from the group consisting of tungsten, nickel, silicon, magnesium, zirconium, and aluminum.

* * * * *